US011867442B2

(12) United States Patent
Kuppusamy

(10) Patent No.: US 11,867,442 B2
(45) Date of Patent: Jan. 9, 2024

(54) AUTOMATIC CLEANING OF ADIABATIC CONDENSER COOLING PADS

(71) Applicant: Heatcraft Refrigeration Products LLC, Stone Mountain, GA (US)

(72) Inventor: Karthick Kuppusamy, Salem (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 288 days.

(21) Appl. No.: 17/344,335

(22) Filed: Jun. 10, 2021

(65) Prior Publication Data

US 2022/0397325 A1 Dec. 15, 2022

(51) Int. Cl.

| | |
|---|---|
| ***F25B 49/02*** | (2006.01) |
| ***F25B 39/04*** | (2006.01) |
| ***F28G 7/00*** | (2006.01) |

(52) U.S. Cl.

CPC ..... *F25B 49/027* (2013.01); *F25B 39/04* (2013.01); *F28G 7/00* (2013.01); *F25B 2700/195* (2013.01)

(58) Field of Classification Search

CPC . F28G 7/00; F28G 15/003; A47L 5/14; A47L 5/38; B08B 3/10; B08B 3/12; F25B 39/04; F25B 49/027; F25B 2700/195; F24F 5/0035; F24F 2221/22; F24F 2110/40; F24F 6/04; F24F 6/06; F28C 1/02; F28C 1/14; F28C 1/16

See application file for complete search history.

(56) References Cited

U.S. PATENT DOCUMENTS

| | | | | |
|---|---|---|---|---|
| 5,401,419 A * | 3/1995 | Kocib | ..... | C02F 5/14 210/698 |
| 6,468,389 B1 * | 10/2002 | Harris | ..... | F28D 5/00 159/901 |
| 2005/0274663 A1 * | 12/2005 | Roitman | ..... | B01D 5/0081 210/263 |

(Continued)

FOREIGN PATENT DOCUMENTS

| | | |
|---|---|---|
| CN | 110822625 A | 2/2020 |
| CN | 112594794 A | 4/2021 |
| DE | 102016011879 A1 | 4/2018 |

(Continued)

OTHER PUBLICATIONS

Extended European Search Report, Application No. 22175462.5, dated Oct. 28, 2022.

(Continued)

*Primary Examiner* — Tavia Sullens
(74) *Attorney, Agent, or Firm* — Baker Botts L.L.P.

(57) ABSTRACT

An adiabatic cooling system includes a condenser coil and one or more adiabatic pads positioned such that intake air for the adiabatic cooling system passes through the pads prior to contacting the condenser coil. The adiabatic cooling system includes a vibration device attached to each adiabatic pad. A controller is communicatively coupled to the vibration device for each of the adiabatic pads. The controller determines that cleaning of the adiabatic pads is needed. In response to detecting cleaning is needed, the controller causes the vibration device attached to each adiabatic pad to vibrate, thereby causing debris in the one or more adiabatic pads to become loosened and/or removed from the adiabatic pads.

20 Claims, 7 Drawing Sheets

(56) References Cited

U.S. PATENT DOCUMENTS

2015/0204626 A1* 7/2015 Martell ..... F28B 9/04
165/200

FOREIGN PATENT DOCUMENTS

| | | | |
|---|---|---|---|
| FR | 2982936 | A1 | 5/2013 |
| KR | 20190138209 | A | 12/2019 |
| WO | 2015108603 | A1 | 7/2015 |
| WO | 2019031709 | A1 | 2/2019 |

OTHER PUBLICATIONS

Kuppusamy, K., "Adiabatic Condenser With Split Cooling Pads," U.S. Appl. No. 17/076,424, filed Oct. 21, 2020, 26 pages.

* cited by examiner

AUTOMATIC CLEANING OF ADIABATIC CONDENSER COOLING PADS

TECHNICAL FIELD

This disclosure relates in general to adiabatic condensers, and more particularly to an automatic cleaning of adiabatic condenser cooling pads.

BACKGROUND

Cooling systems are used in many types of residential and commercial applications. As one example, commercial refrigeration systems are used by many types of businesses such as supermarkets and warehouses.

SUMMARY

A cooling systems may use adiabatic cooling processes to pre-cool intake air that enters an outdoor condenser unit. For example, intake air may first pass through a wet pad or mesh material. Heat transfer with water on the material pre-cools the intake air. During operation, the adiabatic pad or mesh material may collect dust, dirt and other particulates from the surroundings. Impurities in the water used to wet the adiabatic pad or mesh may also cause the buildup of solid debris. These particulates and other debris may restrict the flow of air through the adiabatic pad or mesh, such that cooling performance is decreased. Operation of the cooling system must be stopped for a period of time to clean or replace the adiabatic pads.

This disclosure provides a technical solution to the problems of previous adiabatic cooling technology by allowing condenser cooling pads to be cleaned automatically. Automatic condenser pad cleaning facilitates an increased lifespan of the adiabatic cooling pads and more efficient and reliable performance of the cooling systems in which they are employed. Physical vibration of the adiabatic pads is actuated electronically to loosen and/or remove debris (e.g., using an electronically activated vibration mechanism, such as an eccentric rotating mass (ERM) motor, a linear resonator actuator (LRA) device, or a piezoelectric vibration motor). Vibration may be applied at a resonance frequency of the adiabatic pads to improve debris loosening and removal. In some cases the loosened debris may fall from the pad after vibration. In some cases, a stream of air and/or water may be provided to help remove loosened debris. In some cases, the adiabatic pads may be arranged in a split configuration, and the split pads may be rotated after debris is loosened by the physical vibration, such that the loosened debris is more effectively removed from the adiabatic pads. In some embodiments, operations for cleaning the adiabatic pads may be fully automated. For example, a controller may detect a condition indicating cleaning is appropriate (e.g., an increased air pressure drop across the cleaning pads) and, in response, automatically perform a predefined sequence of cleaning operations (e.g., vibrating the adiabatic pads, rinsing the adiabatic pads, and/or rotating the adiabatic pads).

Certain embodiments may include none, some, or all of the above technical advantages. One or more other technical advantages may be readily apparent to one skilled in the art from the figures, descriptions, and claims included herein.

In an embodiment, an adiabatic cooling system includes a condenser coil and one or more adiabatic pads positioned such that intake air for the adiabatic cooling system passes through the adiabatic pads prior to contacting the condenser coil. He adiabatic cooling system includes a vibration device attached to the adiabatic pad for each of the one or more adiabatic pads a vibration device. The vibration device includes an input interface and an electromechanically responsive portion. The electromechanically responsive portion is operable to physically vibrate in response to an electrical signal received at the input interface. The adiabatic cooling system includes a controller communicatively coupled to the input interface of the vibration device for each of the one or more adiabatic pads. The processor of the controller is configured to determine that cleaning of the one or more adiabatic pads should be initiated. After determining that cleaning of the one or more adiabatic pads should be initiated, an electronic signal is provided to the input interface of the vibration device attached to each of the one or more adiabatic pads. The electronic signal is configured to cause the electromechanically responsive portion of the vibration device for each of the one or more adiabatic pads to physically vibrate, thereby causing debris in the one or more adiabatic pads to become one or both of loosened and removed from the one or more adiabatic pads.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION

Gas cooling systems are used in many types of residential and commercial applications. As one example, commercial refrigeration systems are used by many types of businesses such as supermarkets and warehouses. Many cooling systems use adiabatic cooling processes to pre-cool air before it enters an outdoor condenser unit. For example, large commercial refrigeration systems may include cooling towers where adiabatic pads are contacted (e.g., sprayed) with water in order to pre-cool intake air before it contacts condenser coils. While pre-cooling air using adiabatic pads aids in the overall efficiency of cooling systems in certain environmental conditions, adiabatic pads can be detrimental to the efficiency of the system if airflow through the adiabatic pads becomes obstructed. As an example, pathways for airflow through adiabatic pads may become blocked or clogged with debris resulting from the local environment or from water that is applied to the adiabatic pads. This reduces the overall efficiency of the adiabatic cooling system by increasing the amount of resources (e.g., electricity) needed to operate the system.

To address these and other limitations of previous adiabatic cooling system technology, embodiments of this disclosure facilitate the automatic cleaning of adiabatic pads. For example, if conditions are detected that indicate a possible blockage of airflow through the adiabatic pads, the adiabatic pads may be physically vibrated (e.g., using an electronically actuated vibration mechanism such as an eccentric rotating mass (ERM) motor, a linear resonator actuator (LRA) device, or a piezoelectric vibration motor). Removal of residual debris that remains after being loosened by vibration may be achieved by applying a stream of water and/or air to the adiabatic pads. Certain embodiments may also or alternatively employ split adiabatic pads can be rotated or otherwise moved between different (e.g., open and closed) positions. Examples of adiabatic pads configured for such movement are described in U.S. patent application Ser. No. 17/076,424 by Karthick Kuppusamy and entitled "ADIABATIC CONDENSER WITH SPLIT COOLING PADS," the entirety of which is incorporated herein by reference. Movement of the adiabatic pads may facilitate the removal of debris loosened by physical vibration. The following describes adiabatic cooling systems with adiabatic pads having vibration devices for providing these and other desired features.

Figure 2:
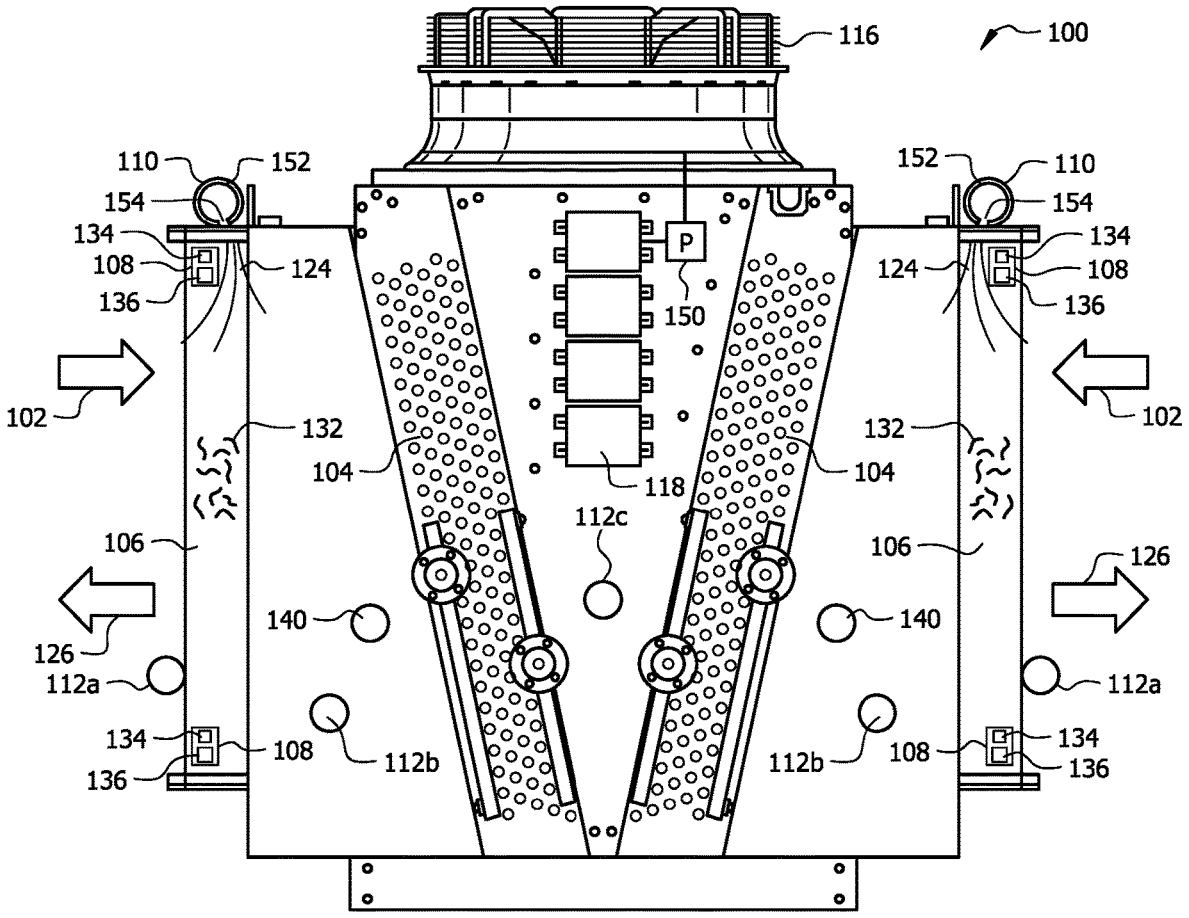
FIG. 2 is a diagram illustrating a cross-sectional view of the adiabatic cooling system of FIG. 1.
Figure 3:
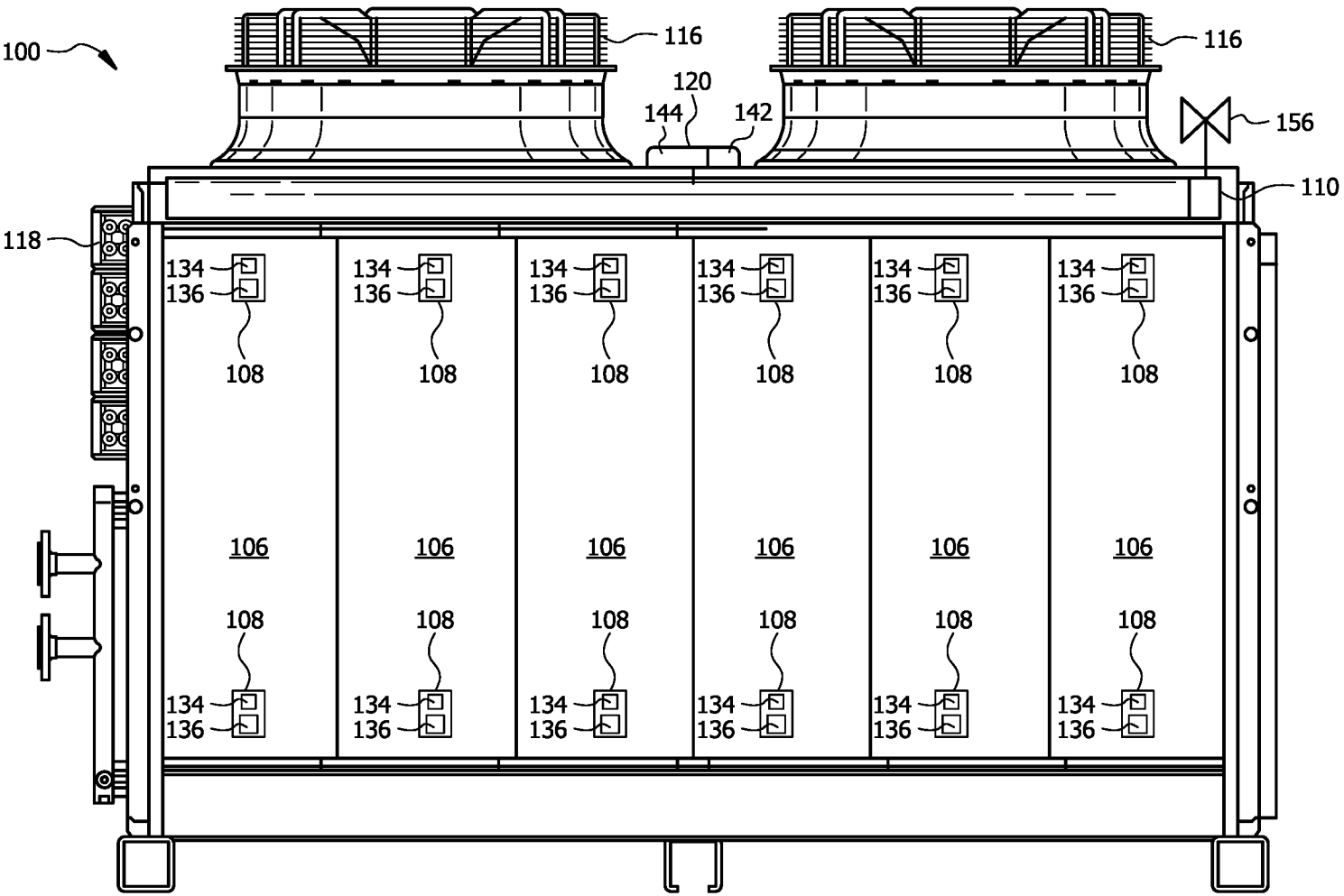
FIG. 3 is a diagram illustrating the adiabatic cooling system of FIG. 1 from a side view.
Figure 4:
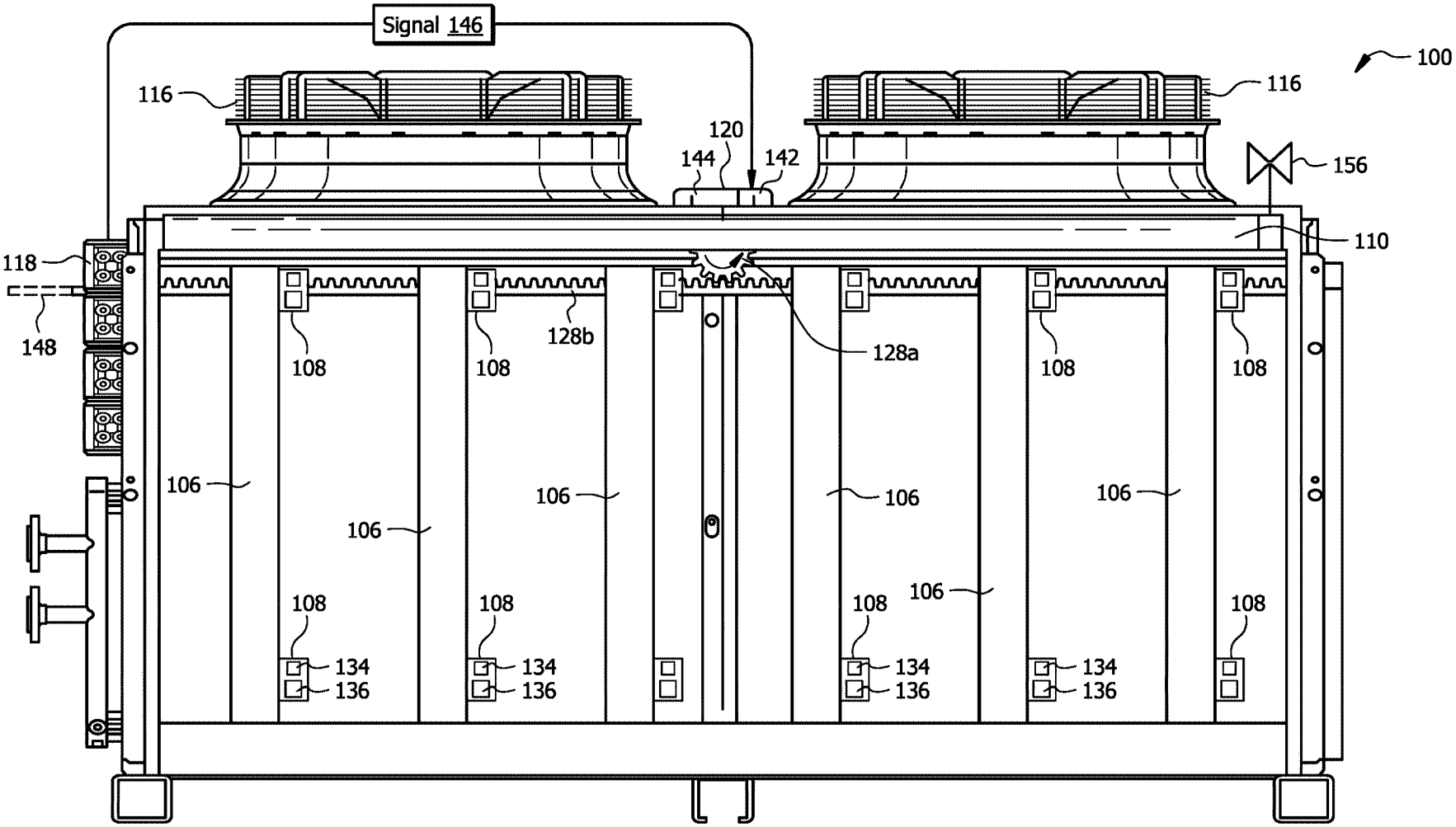
FIG. 4 is a diagram illustrating the adiabatic cooling system of FIG. 1 from a side view with adiabatic pads rotated to facilitate further debris removal.
Figure 5:
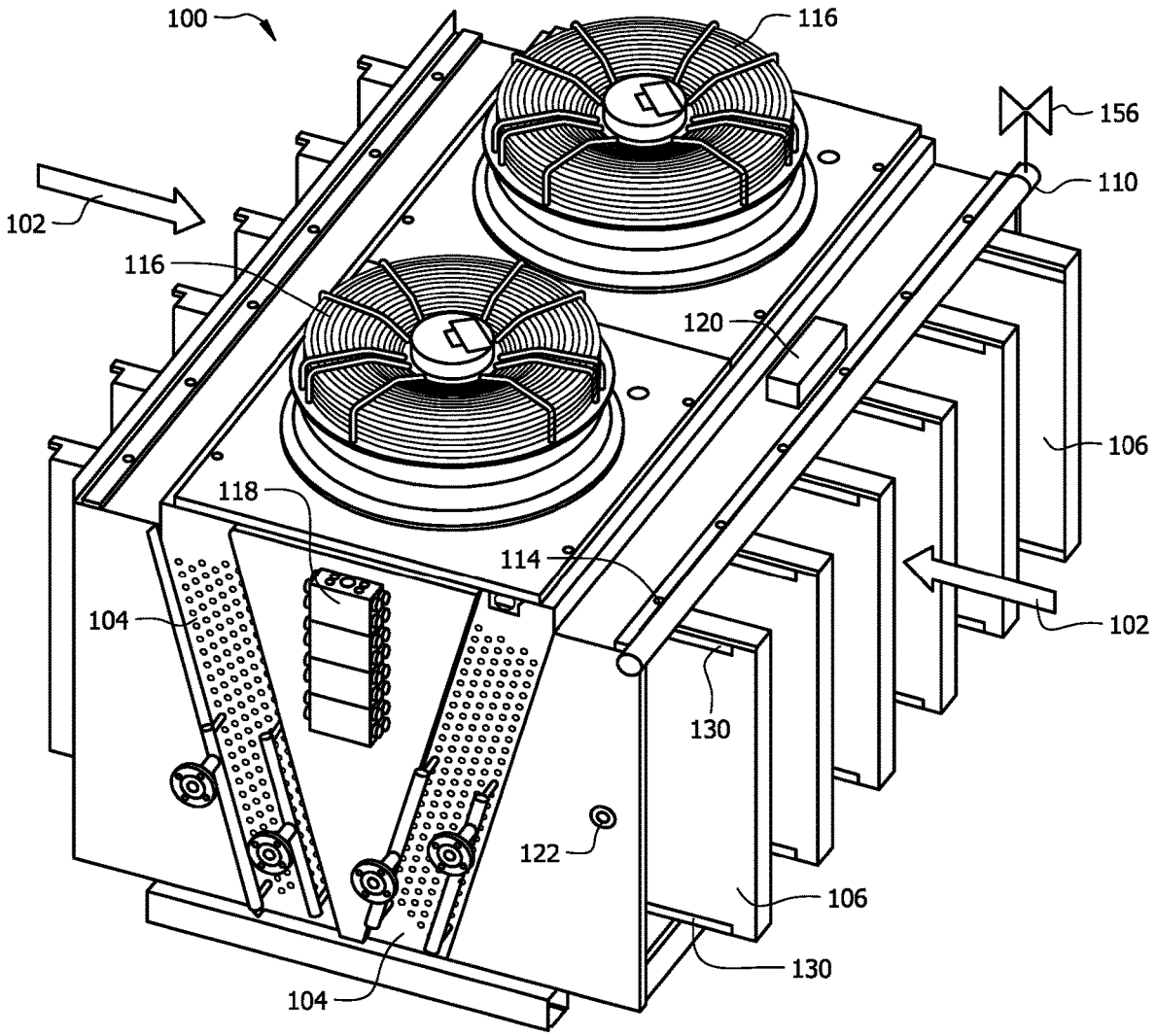
FIG. 5 is a diagram illustrating the adiabatic cooling system of FIG. 1 from a perspective view with adiabatic pads rotated to facilitate further debris removal.

FIGS. 1-5 illustrate an example adiabatic cooling system 100 from various views and with adiabatic pads rotated to either a closed position (FIGS. 1-3) or an open position (FIGS. 4-5). The adiabatic cooling system 100 includes one or more condenser coils 104, one or more adiabatic pads 106, vibration devices 108, a water distributor 110, sensors 112, one or more fans 116, and a controller 118. During operation of the adiabatic cooling system 100, water from the water distributor 110 is applied to adiabatic pads 106 in order to cool intake air 102 as it enters adiabatic cooling system 100 and before contacting condenser coils 104. If debris 132 is trapped or forms via precipitation of salts and/or other impurities from the water provided by the water distributor 110 (see example debris 132 illustrated in FIG. 2), the flow of intake air 102 will decrease or additional power 150 may be required for the fans 116 to maintain a desired rate of airflow. Pressure sensors 112 provide air pressure measurements to the controller 118, which uses this information to determine when the flow of intake air 102 through the adiabatic pads 106 is obstructed by debris for example, based on an increased air pressure drop across the adiabatic pads 106. The controller 118 then causes the vibration devices 108 to vibrate the adiabatic pads 106 at the resonance frequency of the adiabatic pads 106 in order to loosen the debris 132 and, in some cases, remove at least a portion of the loosened debris 132.

In some cases, the controller 118 may initiate further actions to remove residual loosened debris 132 after application of physical vibration by the vibration devices 108 for a period of time. For example, the controller 118 may cause the distributor 110 to provide a water stream 124 and/or cause the fans 116 to reverse airflow direction to provide a reversed airflow 126 to aid in removing loosened debris 132, as illustrated in FIG. 2. In some embodiments, the adiabatic cooling system 100 includes a pad pivoting system 120 for rotating the adiabatic pads 106 to remove debris 132 loosened by physical vibration. The pad pivoting system 120 may be mechanically coupled to adiabatic pads 106 or pad frames 130 (see FIG. 5) holding the adiabatic pads 106 in order to cause the adiabatic pads 106 to move (e.g., between the closed position illustrated in FIGS. 1-3 and the open position of FIGS. 4 and 5). Movement of the adiabatic pads 106 between these positions aids in the removal of debris 132 loosened via application of vibration by the vibration devices 108. As described further below, movement of the adiabatic pads 106 may be implemented automatically by the controller 118 and pad pivoting system 120 or manually using the manual control 122, described further below.

Adiabatic cooling system 100 is a system used to cool a refrigerant by condensing it from its gaseous state to its liquid state in condenser coils 104. In certain refrigeration applications, adiabatic cooling system 100 is located outdoors and is fluidly coupled to indoor portions of the system (e.g., air handlers) via one or more refrigerant lines. In some embodiments, adiabatic cooling system 100 is a cooling tower. Adiabatic cooling system 100 includes one or more condenser coils 104 and one or more motors that turn one or more fans 116. The condenser coils 104 may be any type and configuration of heat exchange coil as appropriate for a given application (e.g., refrigeration, cooling a space, etc.). Fans 116 draw intake air 102 into adiabatic cooling system 100 through adiabatic pads 106, which, if the outdoor temperature is appropriately high, have been sprayed with water from water distributor 110.

The adiabatic pads 106 may be made of any appropriate material that is capable of receiving and retaining water from the water distributor 110. As a specific example, adiabatic pads 106 may be made of a mesh material through which intake air 102 passes before it enters condenser coils 104. As intake air 102 passes through the wet adiabatic pads 106, it cools and helps improve the cooling efficiency of the adiabatic cooling system 100. Adiabatic pads 106 may be in any appropriate size, shape, and configuration and are not limited to those illustrated in the included figures. While the examples of FIGS. 1-5 show six adiabatic pads 106 in the adiabatic cooling system 100, the system 100 could include any appropriate number of adiabatic pads 106 from one or more.

Each adiabatic pad 106 may have one or more vibration devices 108 attached thereto. The examples of FIGS. 1-5 show two vibration devices 108 attached to each adiabatic pad 106. However, in other cases, an adiabatic pad 106 may have only one or more than two vibration devices 108 attached thereto. The vibration devices 108 are generally any mechanism capable of causing the adiabatic pads 106 to physically vibrate with a sufficient intensity to loosen and/or remove debris 132 in or on the adiabatic pads 106. Each vibration device 108 includes an input interface 134 and an electromechanically responsive portion 136 that vibrates in response to a signal 138 received from the controller 118. The input interface 134 is an interface configured to receive a signal 138 from the controller 118 and power from the controller 118 and/or a separate power supply, such as a battery, for powering the vibration device 108. The input interface 134 may include ports or terminals for establishing signal communications with the controller 118. Examples of the electromechanically responsive portion 136 of the vibration devices 108 include an eccentric rotating mass (ERM) motor, a linear resonator actuator (LRA), or a piezoelectric material.

In some embodiments, the vibration devices 108 (e.g., the electromechanically responsive portions 136 of the devices 108) are vibrated at a resonance frequency of the adiabatic pads 106 to which they are attached. For example, the signal 138 provided by the controller 118 has an appropriate amplitude, frequency, and/or other characteristics to cause the electromechanically responsive portion 136 of each vibration device 108 to vibrate at the resonance frequency of the adiabatic pad 106 to which the device 108 is attached. This may aid in providing sufficient physical vibration to effectively remove debris 132. The frequency at which each vibration device 108 vibrates may be predetermined (e.g., via testing and/or modeling) for each adiabatic pad 106, as appropriate. Predetermined resonance frequencies may be stored in a memory of the controller 118 (e.g., as resonance frequency 616 of FIG. 6) and used to instruct the vibration devices 108 to vibrate at an appropriate frequency for debris 132 removal. The loosened and/or removed debris 132 may be dirt, dust, and/or any other particulates that are deposited from the environment in which the adiabatic cooling system 100 is operated. Debris 132 may also form due to precipitation of salts and/or other impurities in water that contacts the adiabatic pads 106 (e.g., from the water distributor 110 and/or the environment).

The water distributor 110 is operable to cause water to contact the adiabatic pads 106. For example, the distributor 110 may be a tube 152 or collection of tubes 152 with appropriate outlet(s) 154 to provide a flow (e.g., as a stream, drip, or spray) of water onto the adiabatic pads 106, such as water stream 124 illustrated in FIG. 2. The outlet(s) 154 are openings in the tube(s) 152 that are located such that the flow of water will contact the adiabatic pads 106. The outlet(s) 154 may include nozzles in some embodiments. The tube(s) 152 of the water distributor 110 are connected to a water source, such as a municipal water supply or the like (not shown for clarity and conciseness). One or more valves 156 are positioned within the tube(s) to control the flow of water into the tube(s) 152 and out of the outlet(s) 154 (see FIG. 1). The valve(s) 156 are communicatively coupled to the controller 118, such that the valve(s) 156 may be opened or closed based on a signal provided by the controller 118 to regulate the flow of water provided to the adiabatic pads 106. In some cases, the controller 118 may instruct the water distributor 110 to provide a water stream 124 (e.g., either a spray or flow of water) onto the adiabatic pads 106 in order to improve the removal of debris 132 that is loosened after physical vibration of the adiabatic pads 106 by the vibration devices 108. For example, the controller 118 may provide instructions to open and/or close one or more valves associated with the water distributor 110.

The adiabatic cooling system 100 may include pressure sensors 112 that are operable to measure an air pressure of the proximate environment (e.g., of intake air 102 on the input (or external) side of the adiabatic pads 106 and on the output (or internal) side of the adiabatic pads 106). As illustrated in the cross-sectional view of FIG. 2, one or more input pressure sensors 112*a* may be positioned on an input side of the adiabatic pads 106 and one or more output-side pressure sensors 112*b,c* may be positioned on an output side of the adiabatic pads 106. As illustrated in the example of FIG. 2, output-side pressure sensors 112*b* may be positioned downstream (in terms of direction of flow of intake air 102) from the adiabatic pads 106 but upstream from the condenser coils 104. Also or alternatively, one or more pressure sensors 112*c* may be located downstream of the condenser coils 104.

The pressure sensors 112 are communicatively coupled to the controller 118. The input-side sensors 112*a* measure an input-side air pressure (e.g., input pressure 608 of FIG. 6), and the output-side pressure sensors 112*b,c* measure an output-side air pressure (e.g., output pressure 610 of FIG. 6). The controller 118 receives air pressure measurements from the input and output pressure sensors 112*a-c* and uses the input and output air pressure to determine an air pressure drop (e.g., pressure drop 612 of FIG. 6) across the adiabatic pads 106 (or across the adiabatic pads 106 and condenser coil 104). The air pressure drop, or the difference in air pressure, between the internal side of the adiabatic pads 106 (e.g., at the location of air pressure sensors 112*b* of FIG. 2) and the external side of the adiabatic pads 106 (e.g., at location of air pressure sensors 112*a* of FIG. 2) increases when the resistance to airflow through the adiabatic pads 106 increases. The presence of debris 132 in the adiabatic pads 106 increases the resistance to airflow and thus also increases the air pressure drop across the adiabatic pads 106.

The controller 118 may use the air pressure drop to detect a decrease in airflow (i.e., a decrease in the flow of intake air 102) across the adiabatic pads 106 (e.g., or an increase in airflow resistance across the adiabatic pads 106). For example, if the air pressure drop is greater than a threshold value (e.g., a threshold 614 of FIG. 6), then a decrease in airflow may be detected and further actions may be taken to automatically clean the adiabatic pads 106 (e.g., by applying vibration to the adiabatic pads 106, providing water stream 124 and/or airflow 126 across the adiabatic pads 106, and/or rotating the adiabatic pads, as described further below).

In some embodiments, the cooling system 100 includes one or more airflow rate sensors 140 located one the output side of the adiabatic pads 106 relative to the direction of intake air 102 (see FIG. 2). The air flow rate sensor(s) 140 are communicatively coupled to the controller 118 and may be any appropriate sensor for measuring an air flow rate (e.g., measured air flow rate 618 of FIG. 6). The controller 118 may use the air flow rate to detect a decrease in airflow (i.e., a decrease in the flow of intake air 102) across the adiabatic pads 106 (e.g., or an increase in airflow resistance across the adiabatic pads 106). For example, if the air flow rate is below a threshold value (e.g., a threshold 614 of FIG. 6), then a decrease in airflow may be detected and further actions may be taken to automatically clean the adiabatic pads 106 (e.g., by applying vibration to the adiabatic pads 106, providing water stream 124 and/or airflow 126 across the adiabatic pads 106, and/or rotating the adiabatic pads, as described further below). In some cases, the controller 118 may operate the fans 116 at a constant airflow rate by using the air flow rate to adjust the power 150 supplied to the fans 116 (see FIG. 2). In such cases, an increase in the power 150 supplied to the fans 116 above a threshold level (e.g., a threshold 614 of FIG. 6) may cause the controller 118 to detect a decrease in airflow across the adiabatic pads 106 and automatically clean the adiabatic pads 106 (e.g., by applying vibration to the adiabatic pads 106, providing water stream 124 and/or airflow 126 across the adiabatic pads 106, and/or rotating the adiabatic pads, as described further below).

In some embodiments, cleaning of the adiabatic pads 106 using the vibration devices 108 may performed automatically without a detected decrease in airflow (or increase in airflow resistance) across the adiabatic pads 106. For example, the controller 118 may automatically cause the vibration devices 108 to vibrate intermittently (e.g., based on the schedule/timer 620 of FIG. 6). Such automatic cleanings may aid in preventing significant buildup of debris 132 in the adiabatic pads 106.

Figure 1:
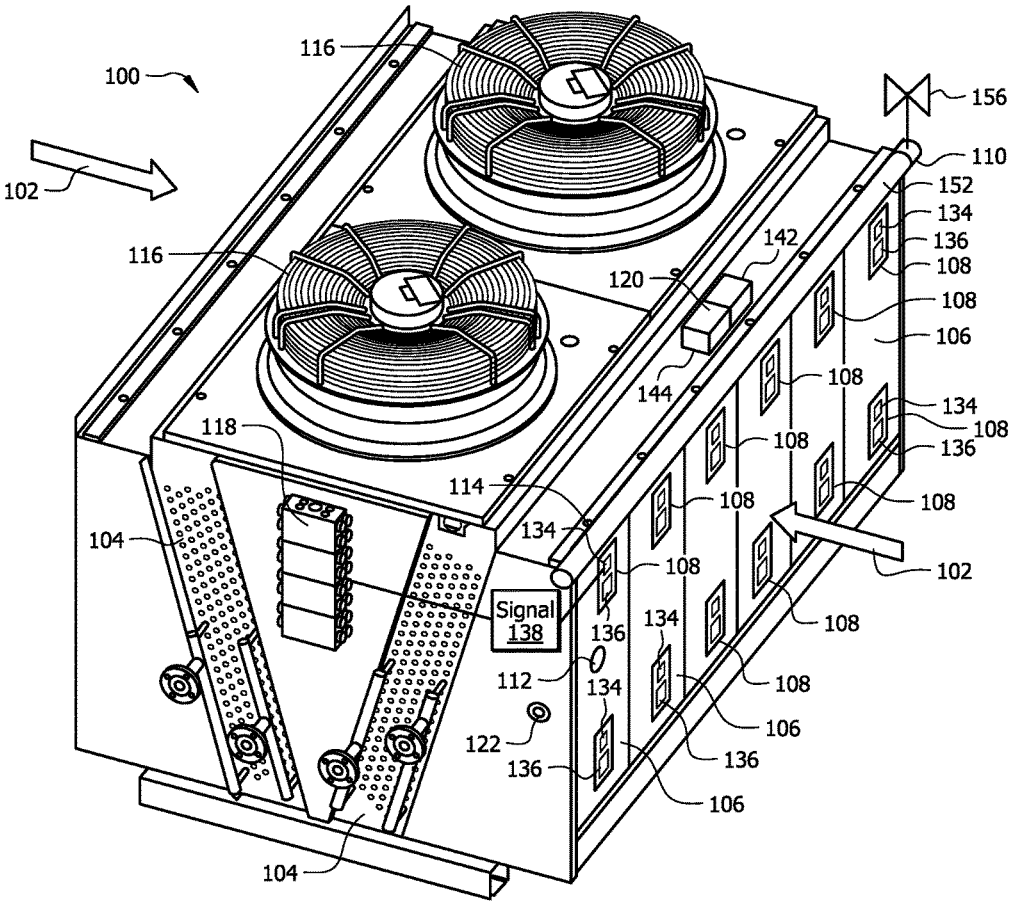
FIG. 1 is a diagram illustrating an example adiabatic cooling system with adiabatic pads configured for automatic cleaning.

In some embodiments, adiabatic pads 106 are configured to pivot or rotate between the closed position illustrated in FIGS. 1-3 and the open position illustrated in FIGS. 4 and 5. Rotation or pivoting of the adiabatic pads 106 may facilitate improved removal of debris 132 loosened by the physical vibration of the adiabatic pads 106. As an example, the adiabatic pads 106 (or pad frames 130) may be coupled to adiabatic cooling system 100 at a pivot point 114 on top of adiabatic cooling system 100 that is proximate a center of adiabatic pad 106 (and/or pad frame 130). In other embodiments (not illustrated for clarity and conciseness), the adiabatic pads 106 (or pad frames 130) may be coupled to adiabatic cooling system 100 at a pivot point 114 on top of adiabatic cooling system 100 that is proximate a center of adiabatic pad 106 (and/or pad frame 130). Further description of various configurations of components for the rotation of the adiabatic pads 106 is described in U.S. patent application Ser. No. 17/076,424 by Karthick Kuppusamy and entitled "ADIABATIC CONDENSER WITH SPLIT COOLING PADS."

In some embodiments, adiabatic cooling system 100 includes pad frames 130 to hold adiabatic pads 106 (see FIG. 5). Pad frames 130 may be formed from any appropriate material such as metal or plastic. As illustrated in FIG. 5, pad frames 130 may include a top portion and bottom portion that allows adiabatic pads 106 to easily slide into and out of pad frames 130. This allows adiabatic pads 106 to be easily removed and installed in pad frames 130. As described above, pad frames 130 may be pivotally coupled to adiabatic cooling system 100 at either an end or near a center of the pad frame 130. In some embodiments, pad frames 130 are mechanically coupled to a pad pivoting system 120 in order to be moved between open and closed positions by the pad pivoting system 120. In other embodiments, adiabatic pads 106 are directly coupled to adiabatic cooling system 100 without using pad frames 130.

Pad pivoting system 120 is any electrical and/or mechanical system that is capable of moving adiabatic pads 106 or pad frames 130 between their open (see FIGS. 1-3) and closed positions (see FIGS. 4 and 5). As shown in FIG. 1, the pad pivoting system 120 includes an interface 142 for communicating with the controller 118 (e.g., for receiving movement instructions 622 of FIG. 6), a motor 144, and a motor-actuated mechanism 128. In some embodiments, the motor-actuated mechanism 128 is a rack and pinion 128, as illustrated in FIG. 4. In such an embodiment, a toothed rack portion 128*b* of rack and pinion 128 is coupled to each adiabatic pad 106 or pad frame 130, and the rack portion 128*b* is mechanically coupled to a pinion portion 128*a* of rack and pinion 128 (e.g., via a gear). The motor 144 turns the pinion portion 128*a* of rack and pinion 128, which thereby moves the rack and all pad frames 130 or adiabatic pads 106 coupled to the rack. The pad pivoting system 120 is communicatively coupled to the controller 118 via interface 142, thereby enabling controller 118 to instruct the pad pivoting system 120 to move the adiabatic pads 106 or pad frames 130 between the open position of FIGS. 4 and 5 and the closed position of FIGS. 1-3.

In some embodiments, a manual control 122 may be coupled to pad pivoting system 120 to provide control of its movements. In some embodiments, the manual control 122 is a switch, button, or other such control on adiabatic cooling system 100 that causes the pad pivoting system 120 to change the positions of the adiabatic pads 106. In some embodiments, manual control 122 may be communicatively coupled to controller 118 or pad pivoting system 120 in order to provide manual control of the positions of adiabatic pads 106. For example, upon selection of a button-type manual control 120, a signal 146 may be provided to the motor 144 of the pad pivoting system 120 to cause the adiabatic pads 106 to move from the closed to open positions (or vice versa) (see FIG. 4).

In some embodiments, as illustrated in the example of FIG. 4, the manual control 122 includes a rod 148 attached to the rack portion 128*b* of the rack and pinion 128. A user may move the rod 148 between an extended position (see dashed line rod 148 in FIG. 4) and a retracted position (see solid line rod 148 in FIG. 4) to cause the adiabatic pads 106 to move between the closed to open positions. A technician may generally operate the manual control 122 in order to move adiabatic pads 106 from their closed positions (FIGS. 1-3) to their open positions (FIGS. 4 and 5) and from their open positions back to their closed positions. This rotating movement may facilitate the removal of residual debris 132 that was loosened by vibration of the adiabatic pads 106 and/or by rinsing of the adiabatic pads with water stream 124 and/or reversed airflow 126. The controller 118 is any appropriate device or circuitry that controls functions of adiabatic cooling system 100. Controller 118 may be within or coupled to adiabatic cooling system 100, or it may be separate from adiabatic cooling system 100 in some embodiments. In some embodiments, controller 118 is a circuit board within adiabatic cooling system 100. Controller 118 is communicatively coupled to the vibration devices 108, pressure sensors 112, and pad pivoting system 120.

Figure 6:
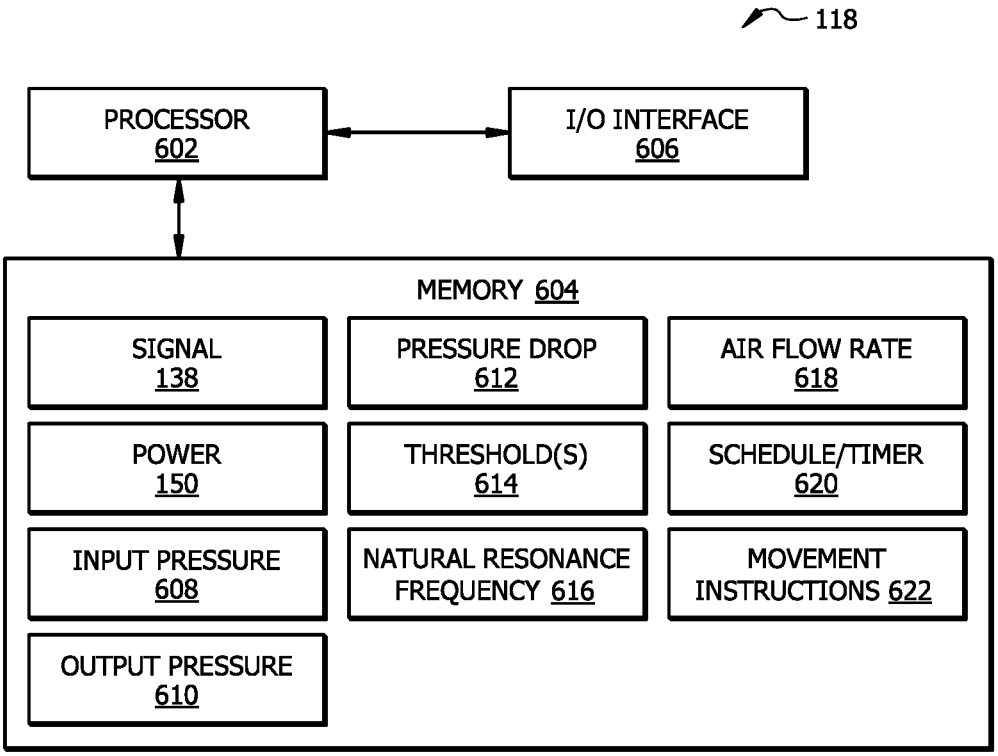
FIG. 6 is a diagram illustrating an example controller of the adiabatic cooling system of FIGS. 1-5.

FIG. 6 illustrates an example controller 118 in greater detail. The controller 118 includes a processor 602, a memory 604, and an input/output (I/O) interface 606. The processor 602 includes one or more processors operably coupled to the memory 604. The processor 602 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 604 and controls the operation of the cooling system 100. The processor 602 may be a programmable logic device, a microcontroller, a microprocessor, or any suitable combination of the preceding. The processor 602 is communicatively coupled to and in signal communication with the memory 604. The one or more processors are configured to process data and may be implemented in hardware or software. For example, the processor 602 may be 8-bit, 16-bit, 32-bit, 64-bit or of any other suitable architecture. The processor 602 may include an arithmetic logic unit (ALU) for performing arithmetic and logic operations, processor registers that supply operands to the ALU and store the results of ALU operations, and a control unit that fetches instructions from memory 604 and executes them by directing the coordinated operations of the ALU, registers, and other components. The processor may include other hardware and software that operates to process information, control the cooling system 100, and perform any of the functions described herein (e.g., with respect to FIG. 7). The processor 602 is not limited to a single processing device and may encompass multiple processing devices. Similarly, the controller 118 is not limited to a single controller but may encompass multiple controllers.

The memory 604 includes one or more disks, tape drives, or solid-state drives, and may be used as an over-flow data storage device, to store programs when such programs are selected for execution, and to store instructions and data that are read during program execution. The memory 604 may be volatile or non-volatile and may include ROM, RAM, ternary content-addressable memory (TCAM), dynamic random-access memory (DRAM), and static random-access memory (SRAM). The memory 604 is operable to store measurements of the input pressure 608 (e.g., from sensor(s) 112*a* of FIG. 2), output pressure 610 (e.g., from sensor(s) 112*b* or 112*c*), a determined pressure drop 612, threshold(s) 614, resonance frequencies 616 that are predetermined for the adiabatic pads 106, air flow rate 618, a schedule/timer 620, movement instructions 622, power 150, signal 138, and any other logic or instructions associated with performing the functions described in this disclosure (e.g., described above with respect to FIGS. 1-5 and below with respect to FIG. 7). The threshold values 614 generally include any of the threshold values described in this disclosure (e.g., a threshold pressure drop above which automatic cleaning is initiated by the controller 118). The resonance frequencies 616 may be predefined or predetermined for the adiabatic pads 106 for the cooling system 100 that is controlled by the controller 118 using testing, modeling, or any other appropriate technique. The air flow rate 618 is a measure of air flow rate through the adiabatic pads 106 measured by air flow rate sensor(s) 140. The schedule/timer 620 defines predetermined times and/or time intervals (e.g., hourly, daily, weekly, etc.) at which the controller 118 automatically causes the vibration devices 108 to vibrate. The movement instructions 622 include any appropriate signals that are provided to the pad pivoting system 120 in order to open and close the adiabatic pads 106, as described above with respect to FIGS. 1-5.

The I/O interface 606 is configured to communicate data and signals with other devices. For example, the I/O interface 606 may be configured to communicate electrical signals with components of the adiabatic cooling system 100 including the vibration devices 108, water distributor 110, pressure sensors 112, pad pivoting system 120, and air flow sensor(s) 140. The I/O interface may receive, for example, pressure signals from sensors 112 and send electrical signals to the vibration devices 108 to cause vibration of adiabatic pads 106 and to the pad pivoting system 120 to rotate the adiabatic pads 106. The I/O interface 606 may include ports or terminals for establishing signal communications between the controller 118 and other devices. The I/O interface 606 may be configured to enable wired and/or wireless communications.

Returning to FIG. 1, in an example operation of the adiabatic cooling system 100, water from the water distributor 110 is applied to adiabatic pads 106 in order to cool intake air 102 as it enters adiabatic cooling system 100 and before contacting condenser coils 104. Throughout operation, the controller 118 uses air pressure measurements from sensors 112 and/or air flow rate measurements from sensor(s) 140 to monitor airflow through the adiabatic pads 106. At some point during operation, the controller 118 detects a decrease in airflow across the one or more adiabatic pads (e.g., based on a determined air pressure drop 612 exceeding a corresponding threshold 614 and/or a determined air flow rate 618 falling below a corresponding threshold 614). In response to detecting the decrease in airflow, the controller 118 causes the vibration devices 108 to activate to provide physical vibration to the adiabatic pads 106. For example, the vibration devices 108 may vibrate at a resonance frequency (e.g., resonance frequency 616 of FIG. 6) of the adiabatic pads 106 (e.g., or within a threshold 614 of the resonance frequency) on which the devices 108 are attached. Vibration at or near the resonance frequency 616 of the adiabatic pads 106 may ensure that sufficient physical vibration of the adiabatic pads 106 is achieved to loosen and/or remove debris 132 blocking airflow through the adiabatic pads 106.

After causing the vibration device for each of the one or more adiabatic pads to vibrate (e.g., for at least a predefined period of time), the controller 118 causes the water distributor 110 to provide the spray of water 124 onto the adiabatic pads 106 to aid in removing at least a portion of residual debris 132 from the adiabatic pads 106 (see FIG. 2). The controller 118 may also or alternatively, cause the fans 116 to provide air in a reverse direction in order to provide reversed airflow 126 across the adiabatic pads 106 (see FIG. 2). This may provide further removal of debris 132 loosened by the vibration devices 108 and/or the water stream 124. Furthermore, the controller 118 may also or alternatively cause the adiabatic pads 106 to rotate about their pivot point 114 (see FIG. 1) to further aid in the removal of residual debris 132 remaining in the adiabatic pads 106. In some cases, an operator may use the manual controller 122 to cause the adiabatic pads 106 to rotate in order to remove residual debris 132 that was loosened by the vibration devices 108.

The components of adiabatic cooling system 100 may be integrated or separated. In some embodiments, components of adiabatic cooling system 100 may each be housed within a single enclosure. The operations of adiabatic cooling system 100 may be performed by more, fewer, or other components. Additionally, operations of adiabatic cooling system 100 may be performed using any suitable logic that may comprise software, hardware, other logic, one or more processors, or any suitable combination of the preceding.

Example Method of Operating the Adiabatic Cooling System

Figure 7:
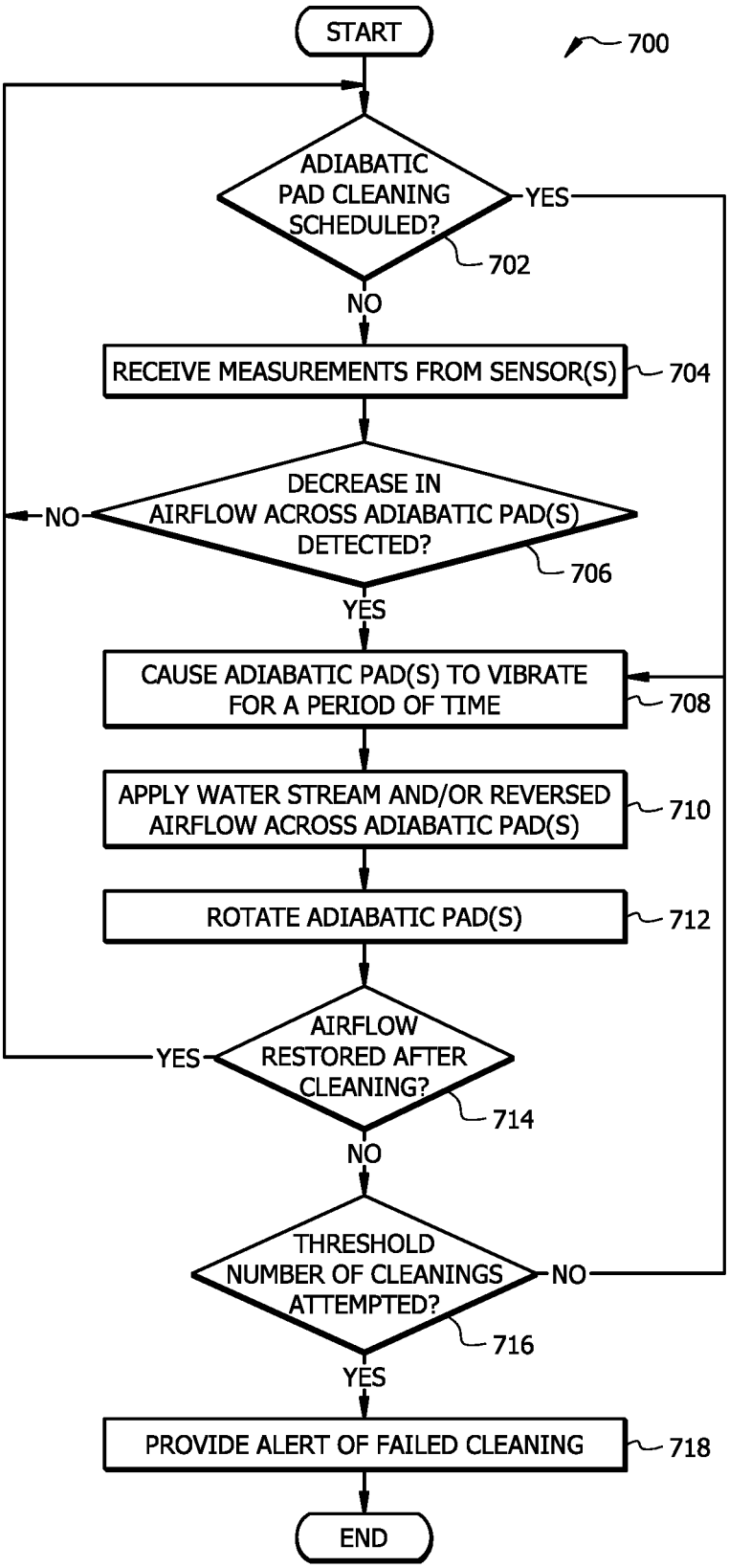
FIG. 7 is a flowchart of an example method of operating the example adiabatic cooling system of FIGS. 1-5.

FIG. 7 illustrates an example method 700 of operating the adiabatic cooling system 100 of FIGS. 1-5. Method 700 facilitates the automatic cleaning of the adiabatic pads 106 described with respect to FIGS. 1-5 above. Method 700 may begin at step 702 where the controller 118 determines whether a cleaning of the adiabatic pads 106 is scheduled, for example, based on the schedule/timer 620. If a cleaning is scheduled, the controller 118 may proceed to the start of pad cleaning at step 708. Otherwise, the controller 118 proceeds to step 704.

At step 704, the controller 118 receives measurements from air pressure sensors 112 and/or airflow rate sensors 140. For example, the controller 118 may receive air pressure measurements from pressure sensors 112. For example, the controller 118 may receive an input pressure 608 from a sensor 112*a* located on an upstream or external side of the adiabatic pads 106 and an output pressure 610 from a sensor 112*b* or 112*c* located on in output or internal side of the adiabatic pads 106, as illustrated in FIG. 2.

At step 706, the controller 118 determines that a decrease in expected airflow is detected across the adiabatic pads 106. For example, if measurements of air pressure 608, 610 are received from air pressure sensors 112, an air pressure drop 612 across the adiabatic pads 106 may be determined as the difference between the input pressure 608 and output pressure 610. If the air pressure drop 612 is greater than the threshold value 614, a decrease in airflow across the adiabatic pads 106 is detected. As another example, if measurements of air flow rate 618 are received from air flow sensor 140, the controller 140 may determine whether the measure air flow rate 618 falls below a threshold vale 614 (e.g., at a constant power 150 provided to the fans 116). For cases in which the fans 116 are configured to operate at a constant air flow rate, the controller 118 may detect a decrease in air flow across the adiabatic pads 106 when the power 150 exceeds a threshold value 614 in order to maintain the constant air flow rate. If a decrease in airflow is detected, the controller 118 proceeds to step 708. Otherwise, the controller 118 returns to step 702.

At step 708, the controller 118 causes the vibration devices 108 attached to the adiabatic pads 106 to physically vibrate. For example, an electronic signal (e.g., a voltage, current) may be provide to the vibration devices 108 in order to cause the vibration devices 108 to physically vibrate. The controller 118 may cause the vibration devices 108 to physically vibrate at the resonance frequency 616 of the adiabatic pads 106. For example, the controller 118 may determine the appropriate resonance frequency 616 that is predefined for each of the one or more adiabatic pads 106 and cause the vibration devices 108 that are attached to the adiabatic pads 106 to physically vibrate at (or within a threshold 614 range of) the corresponding resonance frequency 616.

At step 710, the controller 710 may cause the water distributor to provide a water stream 124 to rinse out a portion of the residual debris 132 remaining in the adiabatic pads 106 (e.g., debris 132 that was loosened at step 708). In some cases, the controller 118 may also or alternatively cause a reversed airflow 126 to be provided by fans 116 in order to facilitate the removal of residual debris 132 from the adiabatic pads 106.

At step 712, the controller 118 may cause the adiabatic pads 106 to rotate (e.g., about the axis 114 illustrated in FIGS. 1-5). For example, the controller 118 may send a signal to the pad pivoting system 120 that causes the pad pivoting system 120 to rotate the adiabatic pads 106, as described with respect to FIGS. 1-5 above. For instance, the adiabatic pads 106 may be cyclically rotated from the closed position of FIGS. 1-3 to the open position of FIGS. 4 and 5 and back to open. This cyclical rotation from open to closed and back to open may be repeated any number of times to aid in removing residual debris 132 from the adiabatic pads 106.

At step 714, the controller 118 may determine whether expected airflow has been restored after cleaning of the adiabatic pads 106 at steps 708, 710, and/or 712. For example, the controller 118 may determine whether, following cleaning the adiabatic pads 106, the pressure drop 612 is now equal to or less than the threshold value 614 used to detect a decreased airflow at step 706. As another example, the controller 118 may determine whether, following cleaning the adiabatic pads 106, the air flow rate 618, at constant fan power 150, is now greater than or equal to the threshold value 614 used to detect a decreased airflow at step 706. As yet another example, the controller 118 may determine whether, following cleaning the adiabatic pads 106, the power 150, at constant air flow rate 618, is now less than or equal to the threshold value 614 used to detect a decreased airflow at step 706. If airflow is restored, the controller 118 returns to the start of method 700. Otherwise, if airflow is not restored, the controller 118 proceeds to step 716.

At step 716, the controller 118 determines if a threshold number 614 of cleaning attempts have been performed. For example, the controller 118 may determine whether steps 708-712 have been completed three times. If the threshold number 614 of attempts has not been completed, the controller 118 returns to step 708 and repeats the cleaning of the adiabatic pads 106. Otherwise, if the threshold number 614 of attempts has been completed, the controller 118 may proceed to step 718 where the controller 118 provides an alert (e.g., to an occupant of the space cooled using the adiabatic cooling system 100, a maintenance provider of the adiabatic cooling system, and/or the like) indicating decreased airflow across the adiabatic pads 106. This alert may facilitate further review and/or maintenance of the adiabatic pads 106.

Modifications, additions, or omissions may be made to method 700 depicted in FIG. 7. Method 700 may include more, fewer, or other steps. For example, steps may be performed in parallel or in any suitable order. While at times discussed as controller 118, or components thereof performing the steps, any suitable device or components of may perform one or more steps of the method 700.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. An adiabatic cooling system, comprising:

a condenser coil;

one or more adiabatic pads positioned such that intake air for the adiabatic cooling system passes through the one or more adiabatic pads prior to contacting the condenser coil;

for each of the one or more adiabatic pads, a vibration device attached to the adiabatic pad, the vibration device comprising an electromechanically responsive portion, wherein the electromechanically responsive portion is operable to physically vibrate;

and a controller communicatively coupled to the vibration device for each of the one or more adiabatic pads, the controller comprising a processor configured to:

determine that cleaning of the one or more adiabatic pads should be initiated; and provide an electronic signal to the vibration device attached to each of the one or more adiabatic pads, wherein the electronic signal is configured to cause the electromechanically responsive portion of the vibration device for each of the one or more adiabatic pads to physically vibrate, thereby causing debris in the one or more adiabatic pads to become one or both of loosened and removed from the one or more adiabatic pads.

2. The adiabatic cooling system of claim 1, further comprising:

a first pressure sensor positioned and configured to measure an input air pressure on an input side of the one or more adiabatic pads;

a second pressure sensor positioned and configured to measure an output air pressure on an output side of the one or more adiabatic pads;

wherein the controller is further communicatively coupled to the first pressure sensor and the second pressure sensor, and the processor determined that cleaning of the one or more adiabatic pads should be initiated by:

determining, based on the input air pressure and the output air pressure, an air pressure drop across the one or more adiabatic pads; and determining that the air pressure drop is greater than a threshold value.

3. The adiabatic cooling system of claim 1, further comprising:

a water distributor comprising a tube, one or more outlets, and a valve, wherein the water distributor is operable, when the valve is in an open position, to provide a flow of water through the one or more outlets onto the one or more adiabatic pads;

wherein the controller is further communicatively coupled to the valve of the water distributor, and the processor is configured to, after providing the electronic signal to the vibration device, cause the valve to open such that the water distributor provides the flow of water onto the one or more adiabatic pads.

4. The adiabatic cooling system of claim 1, wherein the electronic signal provided to the vibration device causes the electromechanically responsive portion of the vibration device to physically vibrate at a frequency within a threshold value of a resonance frequency of the adiabatic pad on which it is attached.

5. The adiabatic cooling system of claim 1, further comprising a pad pivoting system comprising a rack portion, a pinion portion, and a motor, wherein the motor is operable to turn the pinion portion and thereby cause the one or more adiabatic pads to rotate about a corresponding pivot point.

6. The adiabatic cooling system of claim 5, wherein the controller is further communicatively coupled to the pad pivoting system, and the processor is configured to, after providing the electronic signal to the vibration device, cause the one or more adiabatic pads to rotate about the corresponding pivot point.

7. The adiabatic cooling system of claim 1, wherein the processor determined that cleaning of the one or more adiabatic pads should be initiated based on a predetermined schedule or timer.

8. The adiabatic cooling system of claim 1, further comprising:

an air flow rate sensor operable to measure a flow rate of air through the one or more adiabatic pads;

wherein the processor is further communicatively coupled to the air flow rate sensor and determined that cleaning of the one or more adiabatic pads should be initiated by determining that the measured flow rate of air through the one or more adiabatic pads is less than a predefined threshold value.

9. An adiabatic cooling system, comprising:

one or more adiabatic pads;

for each of the one or more adiabatic pads, a vibration device attached to the adiabatic pad, the vibration device comprising an electromechanically responsive portion, wherein the electromechanically responsive portion is operable to physically vibrate; and a controller communicatively coupled to the vibration device for each of the one or more adiabatic pads, the controller comprising a processor configured to:

determine that cleaning of the one or more adiabatic pads should be initiated; and provide an electronic signal to the vibration device attached to each of the one or more adiabatic pads, wherein the electronic signal is configured to cause the electromechanically responsive portion of the vibration device for each of the one or more adiabatic pads to physically vibrate, thereby causing debris in the one or more adiabatic pads to become one or both of loosened and removed from the one or more adiabatic pads.

10. The adiabatic cooling system of claim 9, further comprising:

a first pressure sensor positioned and configured to measure an input air pressure on an input side of the one or more adiabatic pads;

a second pressure sensor positioned and configured to measure an output air pressure on an output side of the one or more adiabatic pads;

wherein the controller is further communicatively coupled to the first pressure sensor and the second pressure sensor, and the processor determined that cleaning of the one or more adiabatic pads should be initiated by:

determining, based on the input air pressure and the output air pressure, an air pressure drop across the one or more adiabatic pads; and determining that the air pressure drop is greater than a threshold value.

11. The adiabatic cooling system of claim 9, further comprising:

a water distributor comprising a tube, one or more outlets, and a valve, wherein the water distributor is operable, when the valve is in an open position, to provide a flow of water through the one or more outlets onto the one or more adiabatic pads;

wherein the controller is further communicatively coupled to the valve of the water distributor, and the processor is configured to, after providing the electronic signal to the vibration device, cause the valve to open such that the water distributor provides the flow of water onto the one or more adiabatic pads.

12. The adiabatic cooling system of claim 9, wherein the electronic signal provided to the vibration device causes the electromechanically responsive portion of the vibration device to physically vibrate at a frequency within a threshold value of a resonance frequency of the adiabatic pad on which it is attached.

13. The adiabatic cooling system of claim 9, further comprising a pad pivoting system comprising a rack portion, a pinion portion, and a motor, wherein the motor is operable to turn the pinion portion and thereby cause the one or more adiabatic pads to rotate about a corresponding pivot point.

14. The adiabatic cooling system of claim 13, wherein the controller is further communicatively coupled to the pad pivoting system, and the processor is configured to, after providing the electronic signal to the vibration device, cause the one or more adiabatic pads to rotate about the corresponding pivot point.

15. The adiabatic cooling system of claim 9, wherein the processor determined that cleaning of the one or more adiabatic pads should be initiated based on a predetermined schedule or timer.

16. A controller of an adiabatic cooling system, the controller comprising:

a processor configured to:

communicate with one or more vibration devices attached to each of one or more adiabatic pads of the adiabatic cooling system, wherein each of the one or more vibration devices comprises an electromechanically responsive portion operable to physically vibrate;

determine that cleaning of the one or more adiabatic pads should be initiated;

provide an electronic signal to the vibration device attached to each of the one or more adiabatic pads, wherein the electronic signal is configured to cause the electromechanically responsive portion of the vibration device for each of the one or more adiabatic pads to physically vibrate, thereby causing debris in the one or more adiabatic pads to become one or both of loosened and removed from the one or more adiabatic pads.

17. The controller of claim 16, wherein:

the processor is further configured to communicate with:

a first pressure sensor positioned and configured to measure an input air pressure on an input side of the one or more adiabatic pads; and a second pressure sensor positioned and configured to measure an output air pressure on an output side of the one or more adiabatic pads; and the processor determined that cleaning of the one or more adiabatic pads should be initiated by:

determining, based on the input air pressure and the output air pressure, an air pressure drop across the one or more adiabatic pads; and determining that the air pressure drop is greater than a threshold value.

18. The controller of claim 16, wherein:

the processor is further configured to communicate with a water distributor comprising a tube, one or more outlets, and a valve, wherein the water distributor is operable, when the valve is in an open position, to provide a flow of water through the one or more outlets onto the one or more adiabatic pads; and the processor is further configured to, after providing the electronic signal to the vibration device, cause the valve to open such that the water distributor provides the flow of water onto the one or more adiabatic pads.

19. The controller of claim 16, wherein the electronic signal provided to the vibration device causes the electromechanically responsive portion of the vibration device to physically vibrate at a frequency within a threshold value of a resonance frequency of the adiabatic pad on which it is attached.

20. The controller of claim 16, wherein:

the processor is further configured to communicate with a pad pivoting system comprising a rack portion, a pinion portion, and a motor, wherein the motor is operable to turn the pinion portion and thereby cause the one or more adiabatic pads to rotate about a corresponding pivot point; and the processor is further configured to, after providing the electronic signal to the vibration device, cause the one or more adiabatic pads to rotate about the corresponding pivot point.

* * * * *